US005207593A

United States Patent [19]

Bogiel

[11] Patent Number: 5,207,593

[45] Date of Patent: May 4, 1993

[54] LATCH RELEASE MECHANISM FOR MATING ELECTRICAL CONNECTORS

[75] Inventor: Steven B. Bogiel, Schaumburg, Ill.

[73] Assignee: Molex Incorporated, Lisle, Ill.

[21] Appl. No.: 931,885

[22] Filed: Aug. 18, 1992

Related U.S. Application Data

[63] Continuation of Ser. No. 792,538, Nov. 13, 1991, abandoned.

[51] Int. Cl.[5] ..... H01R 13/629

[52] U.S. Cl. ..... 439/352; 439/345

[58] Field of Search ..... 439/345, 347, 350, 351, 439/357, 358, 292, 293, 310, 352

[56] References Cited

U.S. PATENT DOCUMENTS

| | | | |
|---|---|---|---|
| 1,613,013 | 1/1927 | Benjamin | 439/347 |
| 1,640,035 | 8/1927 | Haseltine | 392/189 |
| 1,646,482 | 10/1927 | Hopkins | 439/347 |
| 4,273,403 | 6/1981 | Cairns | 439/357 X |
| 4,332,432 | 6/1982 | Colleran | 439/347 |
| 4,441,776 | 4/1984 | Anhalt | 439/347 |
| 4,462,654 | 7/1984 | Aiello | 439/347 |
| 4,535,870 | 8/1985 | Lindsay | 292/19 X |
| 4,568,135 | 2/1986 | Frantz | 439/347 X |
| 4,681,387 | 7/1987 | Paddock | 439/347 |

FOREIGN PATENT DOCUMENTS

| | | | |
|---|---|---|---|
| 860423 | 1/1941 | France | 439/345 |
| 14523 | 1/1984 | Japan | 292/19 |

*Primary Examiner*—Eugene F. Desmond
*Attorney, Agent, or Firm*—Stephen Z. Weiss

[57] ABSTRACT

A latch-release mechanism is disclosed for a pair of electrical connectors movable toward each other in a mating direction into a mated condition. The mechanism includes a latching device on one of the electrical connectors for latchingly engaging a latch on the other electrical connector in response to movement of the connectors into the mated condition. A releasing device is provided for releasing the latching device on the one connector from latching engagement with the latch on the other connector in response to movement of the latching device generally perpendicular to the mating direction of the connectors.

2 Claims, 2 Drawing Sheets

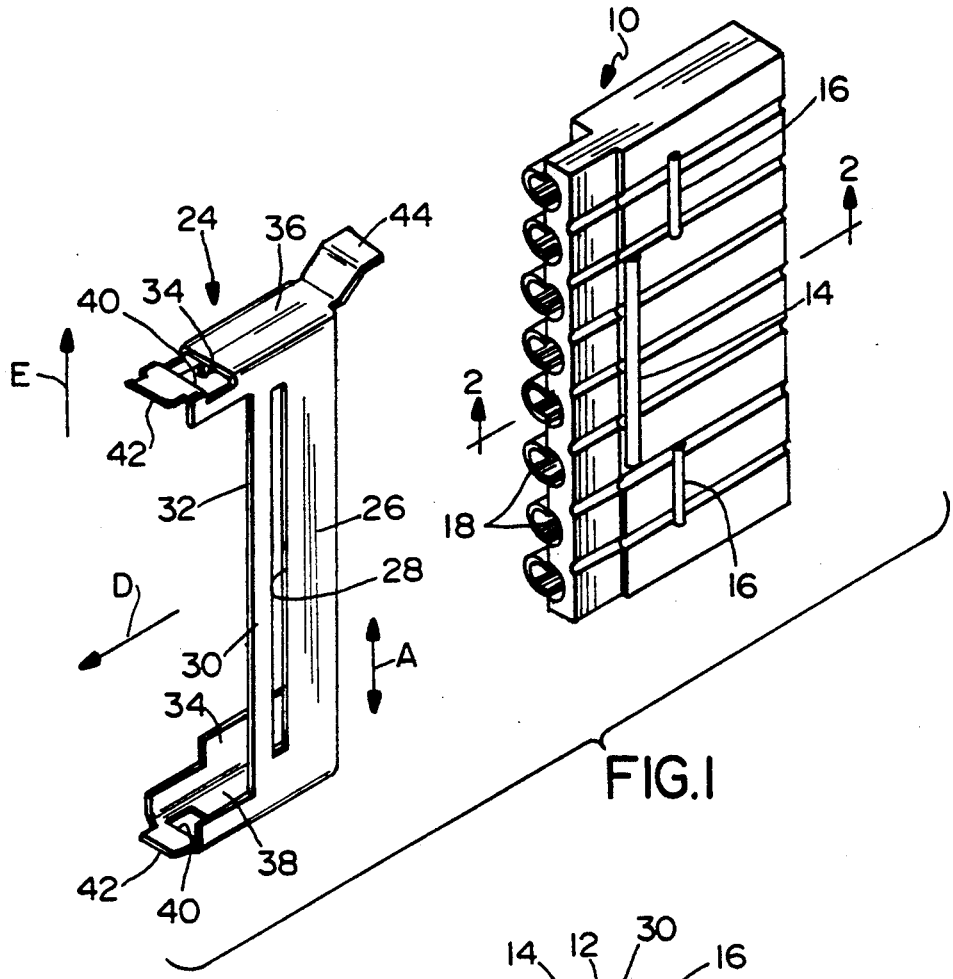
FIG.1
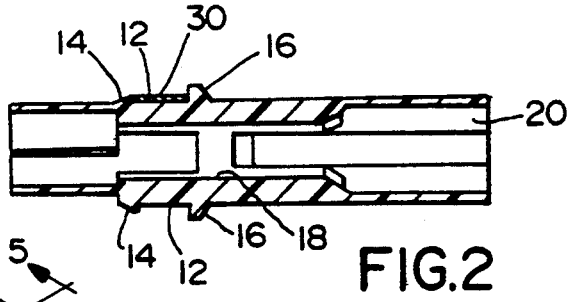
FIG.2
FIG.3
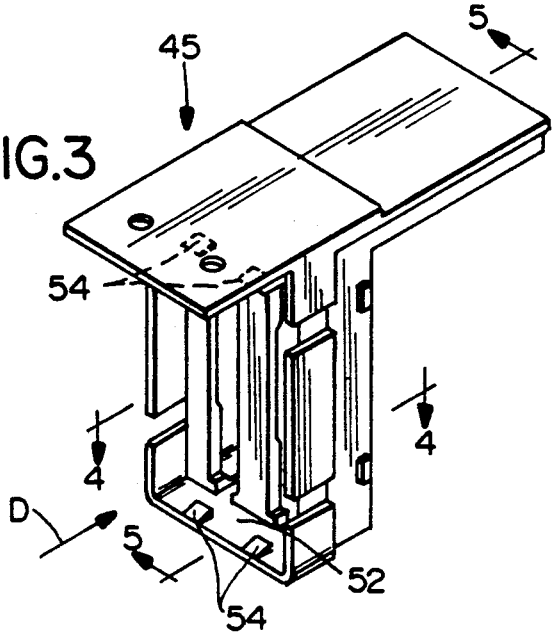
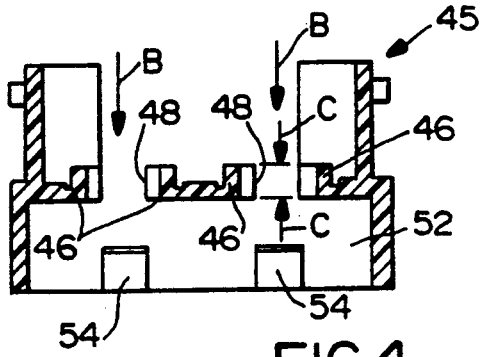
FIG.4

LATCH RELEASE MECHANISM FOR MATING ELECTRICAL CONNECTORS

This is a continuation of copending application Ser. No. 07/792,538 filed on Nov. 13, 1991, now abandoned.

FIELD OF THE INVENTION

This invention generally relates to the art of electrical connectors and, particularly, to a latch-release mechanism for a pair of mating electrical connectors.

BACKGROUND OF THE INVENTION

Mating electrical connectors often are provided with latch-release mechanisms for holding the connectors in mated condition. The most common type of latching mechanism includes a pair of cantilevered spring arms projecting from one electrical connector for snapping into latched engagement with complementary latch means on a mating connector. The spring latch arms may be integrally molded with the housing of the connector, or the latch arms may be fabricated of spring metal material mounted to the outside of the connector housing. Of course, a variety of other latch-release mechanisms have been proposed and/or available.

One of the problems with latch-release mechanisms of the character described is that access must be had to the mated connectors in order to release the latching mechanism to unmate the connectors. Most often, the latch-release mechanisms are disposed on opposite sides of the connectors and, consequently, access must be had to the connectors from the sides thereof in order to release the latching mechanism. It might be proposed to locate the latching mechanisms on the top and bottom of the connectors, rather than the sides thereof, but access to the bottom of a pair of mating connectors often is unavailable. A single latch on either side or the top or bottom of a pair of mating connectors does not adequately mate the connectors.

An example of an environment wherein access to a pair of mating connectors is very limited, is in the field of power cables for interconnecting power lines between panels of a modular wall panel system. Such systems are used to divide a given area into distinct work stations. Most often, tracks are provided along the bottom edge of the wall panels, and power cables run in the tracks to supply power to the various work stations. Power lines usually run in the tracks of each respective panel, and power blocks or connectors are provided at opposite ends of the panels for interconnection. Obviously, with the tracks running along the bottom edges of the panels, access to the mated connectors from the bottom thereof is blocked by a floor structure. The wall panels, themselves, are relatively thin, and, consequently, access to the sides of a pair of mating connectors within the wall panels is limited or totally unavailable.

This invention is directed to solving the problems described above by providing a latch-release mechanism which is latched in response to movement of a pair of electrical connectors in a mating direction and which is released in a direction generally perpendicular to the mating direction.

SUMMARY OF THE INVENTION

An object, therefore, of the invention is to provide a new and improved latch-release mechanism for a pair of electrical connectors movable toward each other in a mating direction into a mated condition.

Generally, in the exemplary embodiments of the invention, a latching device is mounted on one of the electrical connectors for latchingly engaging latch means on the other electrical connector in response to movement of the connectors into their mated condition. Specifically, release means are provided for releasing the latching device from latching engagement with the latch means in response to movement of the latching device generally perpendicular to the mating direction of the connectors.

In some embodiments of the invention, the latching device is mounted on one of the electrical connectors for sliding movement generally perpendicular to the mating direction of the connectors. The latching device on one of the electrical connectors, therefore, is moved from its latching engagement with the latch means on the other electrical connector perpendicular to the direction of mating of the connectors. In the preferred embodiments, the latch means on the other electrical connector include cam means for sliding the latching device generally vertically upwardly when the electrical connectors are mated in a generally horizontal direction. The latching device drops by gravity into latching engagement with the latch means when the connectors are mated. In order to release the latching mechanism, the latching device simply is lifted in order to unmate the connectors.

In another embodiment of the invention, the latching device includes a spring arm on one of the electrical connectors biased into latching engagement with the latch means on the other electrical connector. The release means is provided in the form of a separate releasing device movably mounted on the one electrical connector for moving the spring arm out of latching engagement with the latch means in response to movement of the releasing device generally perpendicular to the mating direction of the connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is an exploded perspective view of a latching device according to the invention, for slidably mounting on an electrical connector as shown;

FIG. 2 is a section taken generally along line 2—2 of FIG. 1;

FIG. 3 is a perspective view of a mounting cap for a pair of mating electrical connectors with latch means for latchingly engaging a pair of the latching devices of FIG. 1;

FIG. 4 is a section taken generally along line 4—4 of FIG. 3;

DETAILED DESCRIPTION OF THE PREFERRED EMBODIMENTS

Figure 5:
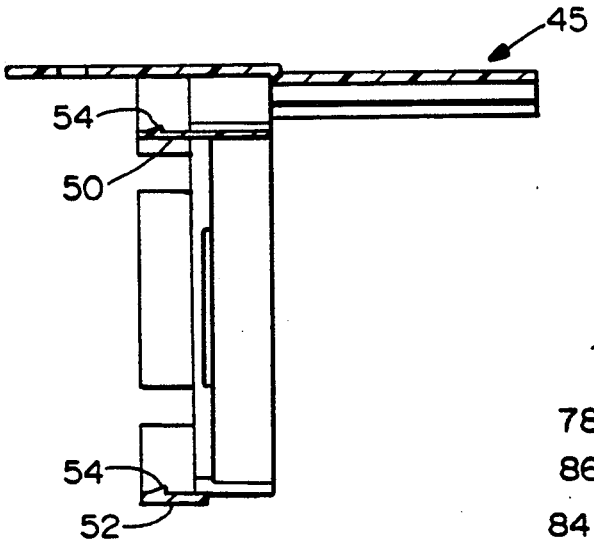
FIG. 5 is a section taken generally along line 5—5 of FIG. 3.

Referring to the drawings in greater detail, and first to FIGS. 1-5, these figures show a first embodiment of the invention for mating at least one pair of electrical connectors, one of which is generally designated 10 in FIG. 1. Only one connector 10 is shown in the drawings because the particular configuration of the mating connectors with which the invention is applicable can vary widely. The one electrical connector shown does illustrate the relevant structure for cooperating with the latch-release mechanisms shown and described herein.

More particularly, referring to FIG. 2 in conjunction with FIG. 1, each electrical connector 10 includes generally vertically oriented groove means 12 (FIG. 2) provided by a center rib 14 and two end ribs 16 (FIG. 1). The connector includes a plurality of through passages 18 for receiving appropriate mating male and female terminals coupled to electrical wires which would project out of a rear end 20 (FIG. 2) of each through passage at a rear terminating end 22 (FIG. 1) of the connector.

Referring particularly to FIG. 1, a latching device, generally designated 24, includes a side wall 26 having an elongated slot 28 to define a rail 30 having a front edge 32. The latching device provides a receptacle means, between side wall 26 and a pair of side wall flanges 34, for receiving one of the electrical connectors 10 therebetween. Rail 30 has a width for sliding between center rib 14 and end ribs 16 on one side of one of the electrical connectors 10. In other words, end ribs 16 on the connector snap into elongated slot 28 in side wall 26 of latching device 24. Center rib 40 locks behind a front edge 32 of rail 30. Consequently, the latching device can slide vertically of the electrical connector as indicated by double-headed arrow "A" (FIG. 1). FIG. 2 shows rail 30 disposed between ribs 14 and 16.

FIG. 1 also shows that latching device 24 has a top wall 36 and a bottom wall 38, each of those walls being provided with a latching aperture 40. Cam ramps 42 are located immediately in front of the latching apertures. It can be seen that both of the cam ramps are curved upwardly for purposes described hereinafter. In addition, a lifting tab 44 is disposed at the rear end of top wall 36, with the lifting tab being bent upwardly for grasping by an operator. Whereas electrical connector 10 includes an integrally molded dielectric housing for receiving the appropriate terminal means, latching device 24 is unitarily fabricated of stamped and formed sheet metal material.

FIGS. 3 and 4 show a mounting structure or end cap 45 for one or a pair of electrical connectors similar to electrical connector 10 for mating with one or a pair of electrical connectors mounted in one or a pair of latching devices 24. More particularly, FIG. 4 shows interior walls 46 defining gaps 48 into which a pair of mating connectors, similar to connector 10, are insertable in the direction of arrows "B". The dimensions of the interior walls, as indicated by arrows "C", are such that the walls seat between ribs 14 and 16 (FIG. 1) to lock a pair of similar mating connectors within the end cap structure. The electrical connectors for positioning in end cap 45 are the same as electrical connector 10, except the connectors in end cap 45 and the connectors in latching devices 24 will have different terminals (i.e., male versus female terminals).

End cap structure 45 includes top and bottom walls 50 and 52, respectively, which are provided with latch means in the form of ramped latches 54. These ramped latches are sized for snapping into latching engagement within apertures 40 (FIG. 1) in top and bottom walls 36 and 38, respectively, of one or a pair of latching devices 24. In other words, it can be seen in FIG. 3 that two pairs of vertically aligned, horizontally spaced latch ramps 54 are provided on end cap 45. Therefore, the end cap can accommodate two mating electrical connectors for mating engagement with a pair of electrical connectors 10 mounted within a pair of latching devices 24. It can be seen particularly in FIG. 5 that both the upper and lower ramped latches 54 face upwardly from top and bottom walls 50 and 52, respectively.

In operation of the latch-release mechanism described above in relation to FIGS. 1-5, an assembly of one electrical connector 10 mounted within one latching device 24 is moved in a mating direction as indicated by arrows "D" for mating with an electrical connector mounted within end cap 45. Normally, this mating direction would be generally horizontal in an environment such as a modular wall panel system as described in the "Background" above. As the respective connectors are mated, a respective vertically aligned pair of the latch ramps 54 will engage the upwardly turned cam ramps 42 of latching device 24, biasing the latching device upwardly in the direction of arrow "E"(FIG. 1). As the respective connectors are moved to their mated condition, latch ramps 54 will become aligned with apertures 40 in the top and bottom walls of latching device 24. When so aligned, the latching device will drop by gravity into a latched condition with the latch ramps 54 locked behind the front edges of apertures 40. Of course, as stated above, since end cap 45 is structured to receive a pair of mating connectors, two assemblies of connectors 10 and latching devices 24 can be mated and latched within the end cap. When it is desired to release the latch-release mechanism and to unmate the connectors, an operator simply lifts latching device 24, by lifting on tab 44 at the top of the latching device, to move the latching device upwardly whereby latch ramps 54 clear apertures 40 and the connectors can be unmated. This vertical movement of the latching device as indicated by arrows "A" and "E", generally perpendicular to the mating direction "D" in FIG. 1, is afforded by the sliding engagement of rail 30 of the latching device disposed between ribs 14 and 16 on the side of the electrical connector.

Figure 6:
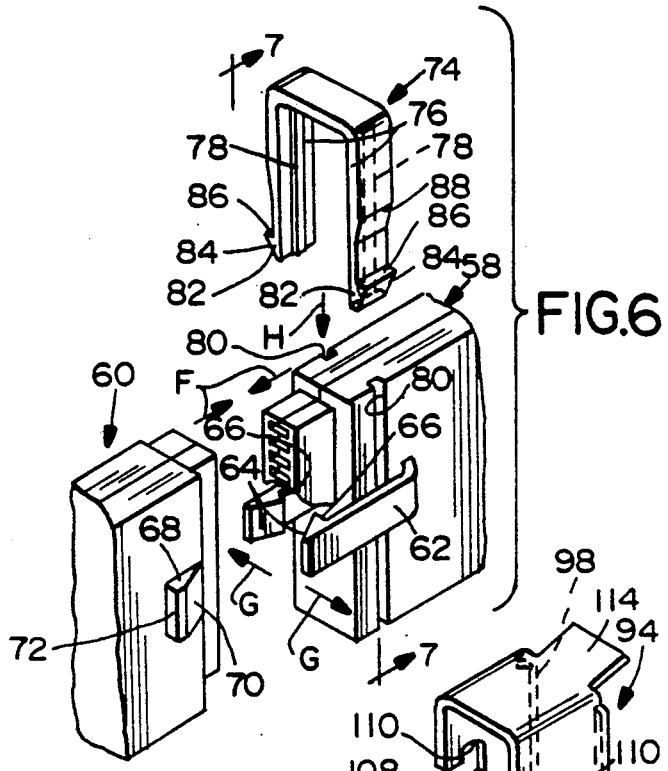
FIG. 6 is an exploded perspective view of a second embodiment of a latch-release mechanism according to the invention.
Figure 7:
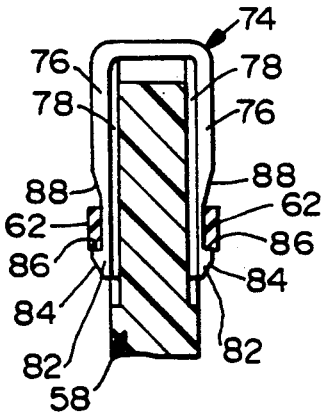
FIG. 7 is a vertical section taken generally along line 7—7 of FIG. 6, with the releasing device in its inoperable position while the mating electrical connectors are mated.
Figure 8:
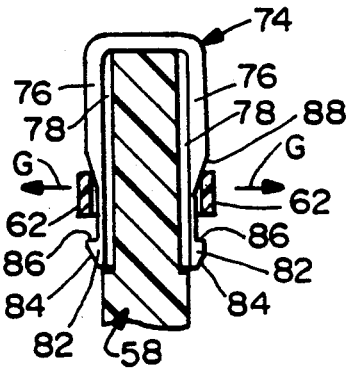
FIG. 8 is a view similar to that of FIG. 7, with the releasing device moved to a position of releasing the latching devices.

FIGS. 6-8 show a second embodiment of the invention wherein one electrical connector, generally designated 58, is mateable with a second electrical connector 60. Connectors 58 and 60 are shown somewhat schematic and are substantially the same as electrical connector 10 (FIG. 1) except for the different embodiment of a latch-release mechanism.

More particularly, the one electrical connector 58 is provided with a pair of cantilevered latch arms 62 on opposite sides thereof, the latch arms terminating in distal ends having cam surfaces 64 leading to latching hooks 66. The latch arms project forwardly beyond the mating end of the connector for engagement with latch bosses 68 molded integrally and projecting outwardly from the sides of mating electrical connector 60. Each latch boss 68 includes a cam ramp 70 and a latching shoulder 72.

Therefore, when electrical connectors 58 and 60 are moved in a mating direction as indicated by arrows "F", cam ramps 64 on latch arms 62 will engage cam ramps 70 on latch bosses 68 to bias the latch arms generally horizontally outwardly in the direction of arrows "G". When the connectors are fully mated, latching hooks 66 on latch arms 62 lock behind latching shoulders 72 of latch bosses 68 to latch the connectors in mated condition.

In order to release latch arms 62 out of latching engagement with latch bosses 68, a generally U-shaped releasing device, generally designated 74, is slidably mounted onto the top of connector 58. The releasing device has a pair of legs 76 provided with integrally molded ribs 78 on the inside thereof. The ribs slide in a pair of vertically oriented grooves 80 formed in opposite sides of electrical connector 58. Therefore, latching device 74 is mounted onto the top of electrical connector 58 in the direction of arrow "H" until distal ends 82 of legs 76 are located below latch arms 72 of the connector. This position is shown in FIG. 7. It can be seen that distal ends 82 have cam surfaces 84 for camming latch arms 62 outwardly to enable the latching device to be mounted on the connector. The distal ends also have stop surfaces 86 to define an upper limit position of the latching device, relative to connector 58, as shown in FIG. 7.

In operation of the latch-release mechanism shown in FIGS. 6–8, with releasing device 74 in an elevated position as shown in FIG. 7, electrical connectors 58 and 60 can be mated in the direction of arrows "F" (FIG. 6), whereupon latch arms 62 and latch bosses 68 of the respective connectors snap into latching engagement. When it is desired to unmate the connectors, latch arms 62 are moved outwardly in the direction of arrows "G" by pushing down on releasing device 74 in the direction of arrow "I" (FIG. 8). Release ramps 88 formed on the outside of legs 76 of the releasing device engage latch arms 62 to bias the latch arms generally horizontally outwardly and perpendicular to the mating direction of the connectors. With releasing device 74 in the position shown in FIG. 8, latch arms 62 are released from latch bosses 68 of connector 60 and the connectors can be unmated.

Figure 10:
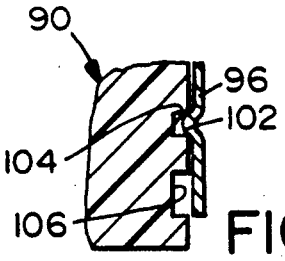
FIG. 10 is a fragmented section through the positioning detent means for the latching device of FIG. 8.
Figure 9:
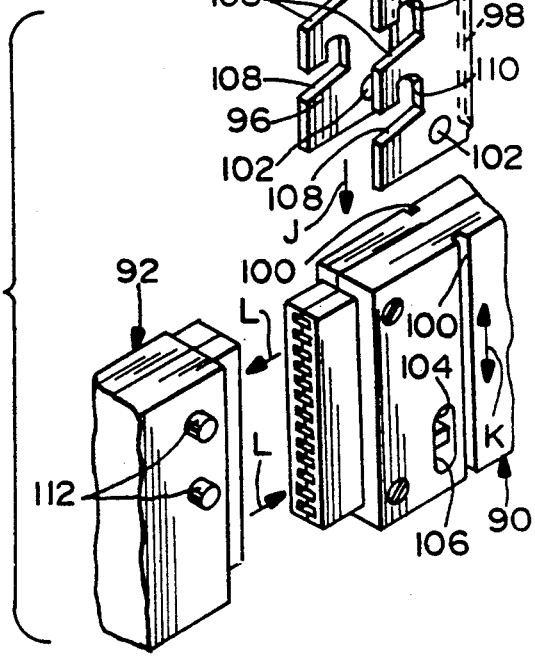
FIG. 9 is an exploded perspective view of a third embodiment of a latch-release mechanism according to the invention.

FIGS. 9 and 10 show a third embodiment of a latch-release mechanism according to the invention. More particularly, again, one electrical connector, generally designated 90, is mateable with a second electrical connector, generally designated 92. A latch-release device, generally designated 94, is fabricated of stamped and formed sheet metal material in a generally U-shape to include a pair of legs 96. Inwardly turned ribs 98 are formed along the rear edges of legs 96 for slidably mounting the latch-release device onto the top of electrical connector 90 by means of the ribs being disposed in grooves 100 formed in the sides of the electrical connector. Therefore, latch-release device 94 is mounted onto the top of connector 90 in the direction of arrow "J" and, when so mounted, the latch-release device can slide relative to the connector in the direction of double-headed arrow "K".

Means are provided between latch-release device 94 and electrical connector 90 to define at least an upper, but preferably upper and lower positions of the latch-release device relative to the connector. More particularly, referring to FIG. 10 in conjunction with FIG. 9, a detent dimple 102 is formed to project inwardly from each leg 96 for seating into upper and lower detent recesses 104 and 106, respectively, formed in the sides of connector 90. With detent dimple 102 seated in upper detent recess 104 as shown in FIG. 10, an elevated unlatched position of latch-release device 94 is defined.

In order to latch electrical connectors 90 and 92 in mated condition, a pair of generally L-shaped slots are stamped in each side wall 96. Each slot has a lower ramp edge 108 leading to a generally vertical latching portion 110 of the slot. Electrical connector 92 has a pair of vertically oriented, spaced latch bosses 112 projecting outwardly from each opposite side of the connector. The latch bosses are oriented for movement into the respective pairs of slots stamped in side legs 96 of latch-release mechanism 94.

In operation of the embodiment of the latch-release mechanism shown in FIGS. 9 and 10, electrical connectors 90 and 92 are moved in a generally horizontal mating direction as indicated by arrows "L", with latch-release device 94 in its upper position defined by detent dimple 102 seated in detent recess 104. As the connectors are moved into mated condition, latch bosses 112 engage ramp edges 108 of the slots in legs 96 of the latch-release device. This engagement drives the device downwardly in the direction of arrow "J", moving detent dimple 102 out of detent recess 104 until the dimple reaches an enlarged detent recess 106 wherein the latch-release device can fall downwardly until latch bosses 112 seat into latching portions 110 of the slots in legs 96. The connectors now cannot be unmated. When it is desired to unmate the connectors, an operator lifts latch-release device upwardly, by engaging or grasping a lifting tab 114 on the top of the latch-release device, to move latch bosses 112 out of latching portions 110 of the slots, whereupon the connectors can be unmated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a latch-release mechanism for a pair of electrical connectors movable toward each other in a mating direction into a mated condition, including a latching device on one of the electrical connectors for latchingly engaging latch means on the other electrical connector in response to movement of the connectors into said mated condition, the improvement comprising a latching device comprising a spring arm biased into latching engagement with the latch means, release means separate from the connector movable between a locking and unlocking position for releasing the latching device from latching engagement with the latch means in response to movement of the latching device generally perpendicular to said mating direction to the unlocking position, said release means held in the locking position by a ramp on the release means in contact with the spring arm, said release means movable generally perpendicular to said mating direction and comprising a releasing device slidably mounted on the one electrical connector whereby moving the release means to the unlocking position will move the spring arm out of latching engagement with the latch means in response to movement of the latching device generally perpendicular to said mating direction.

2. In a latch-release mechanism as set forth in claim 1, wherein said latching device comprises two spring arms on opposite sides of one of said electrical connectors whereby moving the release means to the unlocking position will move the spring arms in opposite directions out of latching engagement with the latch means.

* * * * *